US008875953B2

(12) United States Patent
Corbin et al.

(10) Patent No.: US 8,875,953 B2
(45) Date of Patent: Nov. 4, 2014

(54) PUMP FOR LIQUID OR VISCOUS PRODUCT

(75) Inventors: Jean-Yves Corbin, Thaon (FR); Mathias D'estais, Caen (FR); Laurent Clisson, Bourg-la-Reine (FR)

(73) Assignee: Capital Innovation (SARL), St. Ouen Cedex (FR)

( * ) Notice: Subject to any disclaimer, the term of this patent is extended or adjusted under 35 U.S.C. 154(b) by 406 days.

(21) Appl. No.: 12/811,950

(22) PCT Filed: Jan. 7, 2009

(86) PCT No.: PCT/FR2009/000006
§ 371 (c)(1),
(2), (4) Date: Jul. 7, 2010

(87) PCT Pub. No.: WO2009/112660
PCT Pub. Date: Sep. 17, 2009

(65) Prior Publication Data

US 2010/0276456 A1 Nov. 4, 2010

(30) Foreign Application Priority Data

Jan. 9, 2008 (FR) ..... 08 00132

(51) Int. Cl.

| | |
|---|---|
| ***B05C 17/01*** | (2006.01) |
| ***B05B 11/00*** | (2006.01) |
| ***B65D 83/00*** | (2006.01) |
| ***B65D 47/20*** | (2006.01) |
| *A45D 34/04* | (2006.01) |

(52) U.S. Cl.

CPC ..... *B05B 11/0024* (2013.01); *B05B 11/0059* (2013.01); *B05B 11/0043* (2013.01); *B05B 11/3033* (2013.01); *B65D 83/0094* (2013.01); *A45D 2200/056* (2013.01); *A45D 34/04* (2013.01); *B05B 11/007* (2013.01); *B05B 11/0072* (2013.01); *B05B 11/3028* (2013.01); *B65D 47/2031* (2013.01)

USPC ..... 222/205; 222/213; 222/207

(58) Field of Classification Search

USPC ..... 222/207, 185.1, 321.8, 372, 213, 490, 222/205

See application file for complete search history.

(56) References Cited

U.S. PATENT DOCUMENTS 1,739,871 A * 12/1929 Smith ..... 222/490
2,219,604 A * 10/1940 Trotter ..... 222/207

(Continued)

FOREIGN PATENT DOCUMENTS

EP 1 123 746 A1 8/2001
EP 1 716 928 A2 11/2006

(Continued)

OTHER PUBLICATIONS

International Search Report w/translation from PCT/FR2009/000006 dated Jul. 10, 2009 (6 pages).

*Primary Examiner* — Paul R Durand
*Assistant Examiner* — Donnell Long
(74) *Attorney, Agent, or Firm* — Osha Liang LLP

(57) ABSTRACT

Pump operable manually or by a utensil held by a user, having an elastically deformable chamber, the inside of which contains a liquid or viscous product, and the outside of which is brought into contact with air at a slit made in this chamber and with a replacement fluid at an opening made on the chamber. The chamber is suited to deforming, by pressing of a user, to create a higher pressure in the product compared to the outside, and to open the slit, allowing a volume of product to escape from it. The chamber is suited to making its deformation elastically disappear, upon cessation of the pressing, to create a lower pressure in the product, in the presence of a flow of replacement fluid through the opening towards the inside, and to close the slit, where the chamber wall is planar in the vicinity of the slit.

2 Claims, 2 Drawing Sheets

(56) References Cited

U.S. PATENT DOCUMENTS

Figure 1:
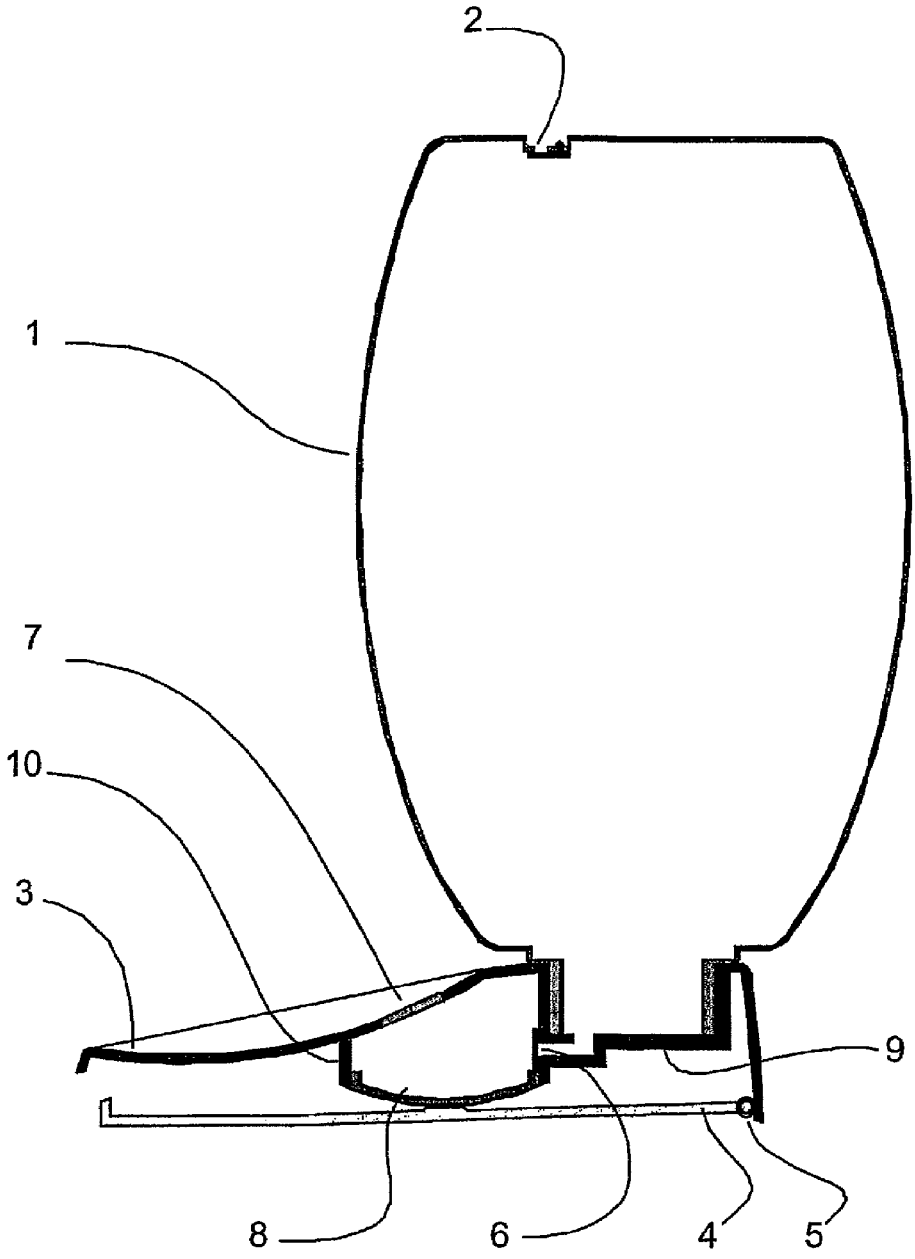

| | | | | | |
|---|---|---|---|---|---|
| 2,670,884 | A | * | 3/1954 | Swartz | 222/490 |
| 2,942,762 | A | * | 6/1960 | Fahr | 222/207 |
| 2,979,236 | A | * | 4/1961 | Fahr | 222/207 |
| 3,258,175 | A | * | 6/1966 | Taylor | 222/380 |
| 3,286,931 | A | * | 11/1966 | Webb | 239/284.1 |
| 3,342,318 | A | * | 9/1967 | Ruekberg et al. | 206/540 |
| 3,485,419 | A | * | 12/1969 | Taylor | 222/340 |
| 3,820,689 | A | * | 6/1974 | Cocita | 222/207 |
| 4,142,651 | A | * | 3/1979 | Leopoldi et al. | 222/185.1 |
| 5,176,510 | A | * | 1/1993 | Nilsson | 417/479 |
| 5,186,368 | A | * | 2/1993 | Garcia | 222/490 |
| 5,271,432 | A | * | 12/1993 | Gueret | 137/854 |
| 5,377,880 | A | * | 1/1995 | Moretti | 222/207 |
| 5,379,919 | A | * | 1/1995 | Gueret | 222/108 |
| 5,431,634 | A | * | 7/1995 | Brown | 604/153 |
| 5,730,336 | A | * | 3/1998 | Lerner | 222/490 |
| 5,862,955 | A | * | 1/1999 | Albini et al. | 222/212 |
| 5,971,224 | A | * | 10/1999 | Garibaldi | 222/207 |
| 6,450,375 | B1 | * | 9/2002 | Hins et al. | 222/491 |
| 6,494,346 | B2 | * | 12/2002 | Gross et al. | 222/185.1 |
| 6,789,706 | B2 | * | 9/2004 | Abergel et al. | 222/207 |
| 8,109,412 | B2 | * | 2/2012 | Decottignies et al. | 222/108 |
| 2007/0262091 | A1 | | 11/2007 | Harper | |

FOREIGN PATENT DOCUMENTS

| | | | | |
|---|---|---|---|---|
| FR | 2 489 791 | A1 | | 3/1982 |
| FR | 2 856 388 | A1 | | 12/2004 |
| FR | 2856388 | A1 | * | 12/2004 |
| WO | 2008/007747 | A1 | | 1/2008 |

* cited by examiner

PUMP FOR LIQUID OR VISCOUS PRODUCT

The invention relates in particular to a pump that may be used for a liquid or viscous product for dishwashing or cosmetics operable by means of a washing utensil held in only one hand by a user, for dishwashing, or operable with reduced effort of the hand until inducing a sensation of caress, for cosmetics.

STATE OF THE PRIOR ART

In the field of packaging dispensers of liquid or viscous fluids, such as products for dishwashing or cosmetics, orifices for the outflow of a product formed by slits are known.

American patent US 2007/0262091 of Harper discloses an outlet orifice which is a sealed slit formed either by the lips of two membranes laid flat against each other, or formed by the edge of a bag held tight by an elastic component. In a vicinity of these sealed slits, the walls of the membranes do not constitute a plane but either two superimposed half-planes, or a cylinder.

French patent FR 2489791 of Sukop and Menrad discloses a spout valve provided with a sealed slit. In a vicinity of this sealed slit, the walls of the spout do not constitute a plane but two half-planes forming between them an acute angle.

European patent EP 1123746 of Bonningue, discloses two sealed slits with sloping faces to form a pump. In a vicinity of these sealed slits, the walls of their faces do not constitute a plane but two half-planes forming between them an acute angle.

International patent application WO 2008/007747 of Katayama, discloses a valve of spherical shape provided with a sealed slit. In a vicinity of the sealed slit, the walls of the valve do not constitute a plane but form a sphere.

It will be noted in these designs of the prior art, that the walls, in the vicinity of the slits of the prior art or "sealed slits", are essentially non planar seen from the outside. The sealed slits effectively have, as a result, a good sealing vis-à-vis the outside, external atmospheric pressure pressing in the vicinity of these sealed slits, on their edges, tending to maintain them hermetically sealed, blocked. Unfortunately, the sealed slits also have, for the same reason, mediocre ergonomics for the design of a pump operable with reduced effort of the hand until inducing a sensation of caress. They have, in fact, a protuberance in the vicinity of the sealed slit that is felt by the user and which does not favour the integral collection of the liquid dispensed via the sealed slit in a continuous gesture, unlike a simple slit or "slit" according to the present invention, formed in a chamber with an essentially planar wall in the vicinity of the slit, for example by incision of this wall.

Nevertheless, a simple slit is considered open to flow in one direction and in the other. It is thus not conceivable at first sight to use it to pump a product from a reservoir in a reproducible and clean manner when said reservoir is deformable elastically, as the product flows outside of the reservoir via the slit. Indeed, for a slit formed in a reservoir bathed in air, the open to flow aspect of the slit leads to allowing the product to escape outside of the reservoir during the deformation of said reservoir and to letting in air through the slit to replace the product of the reservoir when the deformation disappears, which does not constitute a pump but a simple outlet orifice. Thus, it does not appear simple to form a pump by a slit in a reservoir or a pump comprising as escape valve a slit in a compression chamber, and there is a risk of pollution or contamination of the product in the reservoir from outside with such a configuration, which leads to the conclusion of an impossibility of using a slit for a pump. Thus, in the configurations known from the prior art, the slit generally has the function of protection of the liquid of the reservoir against soiling or drying out by the creation of a confined atmosphere. Although in the prior art it is designated "sealed slit", it is simply a protection.

In other known designs, a slit is also used for a "stop drip" function, in particular in bottles for free-running liquids such as, in particular, honey or washing up liquid. The function of the slit is then a flow stop, with the same difficulties of adaptation to a pump as mentioned above.

DRAWBACKS OF THE PRIOR ART

The solutions of the prior art for dispensers of liquids using slits to dispense the liquid generally have an imperfect sealing and a risk of contamination of the contents, which appears to preclude the creation of a pumping system.

SOLUTION PROVIDED BY THE INVENTION

To overcome these drawbacks, the invention, according to its most general acceptance, relates to a pump operable manually or by a utensil held in one hand by a user, which comprises an elastically deformable chamber, the inside of which is suited to containing a liquid or viscous product and the outside of which is intended to be brought into contact with air at a slit made on this chamber and brought into contact with a replacement fluid at an opening made on said chamber, the chamber being suited to deform elastically, by a pressing of a user, to create a higher pressure in the product in relation to the outside, and to open the slit, allowing a useful volume of product to escape from it, the chamber being suited to making its deformation elastically disappear, following the cessation of the pressing of the user, to create a lower pressure in the product, in the presence of a flow of replacement fluid via the opening towards the inside and to close the slit, and the wall of the chamber being essentially planar viewed from the outside in the vicinity of said slit.

According to advantageous alternatives:

- the replacement fluid is said product
- the replacement fluid is air
- the opening is a hole in the chamber (10)
- the opening is a flexible valve formed of a hole in the chamber (10) and a clapper suited to covering the hole, in a hermetic manner to said product, in the presence of the higher pressure, and suited to allowing the free circulation of replacement fluid via the hole under the effect of the lower pressure
- the chamber (10) comprises a support part (203), longer and wider than the slit, on which the slit is capable of being laid flat in a hermetic manner to air, under the effect of the lower pressure
- the chamber (10) comprises an added thickness which is situated inside the chamber, which arises on the edges of the slit and which is slit from said edges over a part of its thickness, to make the admission of air more difficult, compared to the escape of the product, via the slit
- the slit is flared towards the inside of the chamber (10), so as to facilitate the escape of the product, compared to the admission of air, via the slit
- the chamber (10) is firstly deformable elastically by pinching by means of a finger of the hand of the user, by creating in the chamber a first part comprising the slit and a second part comprising the opening, then is deformable by sliding the finger on the chamber (10), while maintaining the pinching, to make the product escape from the first part via the slit and to make the deformation of the second part disappear and to let the replacement fluid into it the chamber is composed of a first and second sub-assembly and means to connect said sub-assemblies in a sealed manner to the product, to the air and to the replacement fluid, the first sub-assembly comprising the slit and the second sub-assembly comprising the opening.

The invention also relates to the application of said pump or one of its alternatives to a reservoir of dishwashing product or cosmetic, connected to said opening, and deformable or provided with an air inlet, to form a dispenser of said product, operable by a user, manually or by means of a utensil held in one hand.

DETAILED DESCRIPTION OF A NON-LIMITING EMBODIMENT OF THE INVENTION

Figure 2A:
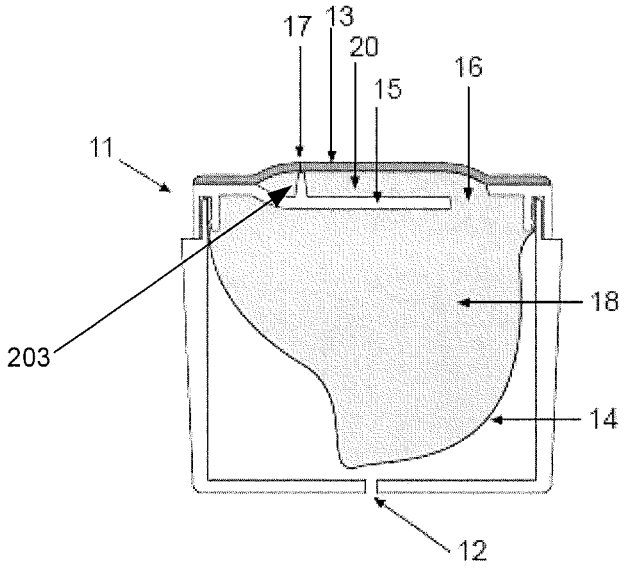
Figure 2B:
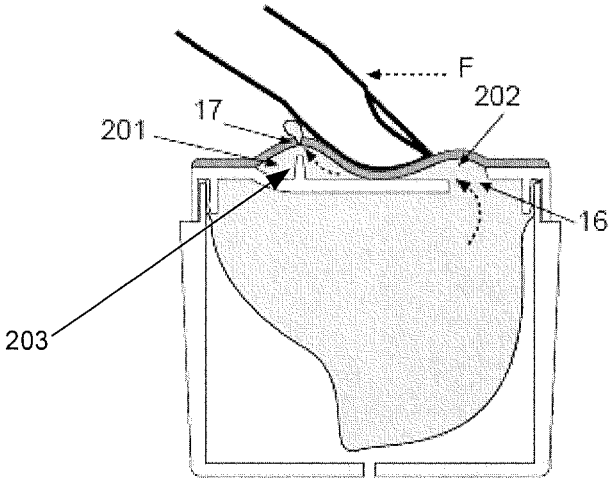

The description of the invention is given for its embodiments, in reference to:

FIG. 1, representing in cross section, the pump in its application to a reservoir of product for dishwashing FIGS. 2*a* and 2*b*, representing in cross section, the pump in its application to a pot for cosmetics, which is a product reservoir of the "bag in box" type.

The invention is represented in FIG. 1 in its application to a reservoir (1) of product for dishwashing provided with an air inlet (2), a cup (3), connected to a pump according to the invention comprising an elastically deformable chamber (10) and bathed in an external medium which is air, a slit (7) and an opening (6), the chamber containing a liquid or viscous product (8), the reservoir resting on a sole piece (4), provided with a hinge (5) and a part (9) forming a stopper.

In reference to this figure, a user presses on the cup (3) and deforms the chamber of the pump (10) between the cup and the sole piece (4). The product (8) escapes from the deformed chamber via the slit and the opening (6) which is an elastically deformable clapper above a hole, under the effect of the pressure of the user transmitted by the product (8), which creates a higher pressure in the product in relation to the external environment. The clapper covers the hole and closes it, preventing the product from coming out any longer via the opening. When the user releases his pressing, the chamber tends to recover elastically its shape at rest, creating a lower pressure in the product in relation to the external medium. The clapper recovers its rest position, leaving the hole open and enabling the admission of product from the reservoir into the chamber, as replacement of the product that has escaped via the slit during the deformation. In an advantageous configuration to limit backflows of liquid from the chamber towards the reservoir, the clapper may be capable of sealing the opening in rest position as well as during higher pressure in the product and only to open under the effect of lower pressure in the product.

A clapper according to the invention will be, generally speaking, suited to covering the hole in presence of higher pressure and leaving said hole open in presence of lower pressure. A slit according to the invention will be, generally speaking, suited to opening in presence of higher pressure and closing in presence of lower pressure. The slit and the clapper according to the invention will be chosen so that an increase in the pressure value, starting from an equality of internal and external pressures around the chamber, leads to the closing of the clapper and the opening of the slit and so that a reduction in the pressure from a situation where the slit is open and the clapper closed leads to a closing of the slit and an opening of the clapper corresponding to an aspiration of the replacement fluid or of the product contained in the reservoir, by the opening of said clapper, with a choice of the admission via the clapper enabling the reduction of the higher pressure and its transformation into lower pressure, without exceeding a value of the lower pressure which would open the slit by deformation towards the inside of the chamber and let air into it.

If the slit and the opening according to the invention are adapted so that the diameter of the opening and the characteristics of the slit enable an escape of the product preferentially via the slit, when the chamber is deformed, rather than via the opening and inversely an admission of a volume of product or replacement fluid via the opening rather than a volume of air via the slit, during the disappearance of the deformation of the chamber, then it is possible to pump the product from the reservoir up to the cup by elastic deformation of the chamber, then disappearance of this deformation.

With a clapper, the stiffness of the clapper may be played on so that the closing of the hole of the opening takes place at a pressure on the clapper less than that inducing the opening of the slit, said pressure being able to be nonexistent if the clapper closes the hole at equality of pressures around or on the two sides or inside and outside the chamber. In this case, and for a slit obtained by simple incision of the chamber, if it is made of an elastomer, releasing the pressing of the user will enable the opening of the hole by the clapper, the slit being closed, and the admission of replacement product via the opening rather than air via the slit.

It is thus possible to have available, for any type of chamber and slit, a criterion making it possible to optimise the opening to obtain a pump according to the invention.

A valve or opening (6) as presented in FIG. 1 may thus be formed by a cylindrical elastomer zone of 1.5 mm thickness and 12 mm diameter, added on or bi-injected into the cup (3) such that it is firmly held on the edges. It may be a silicone elastomer of 40 Shore A hardness type. The traversing slit (7) may be of 6 mm length, which gives it the possibility of opening during a manual compression of the dome of the chamber with a force of around 2 Newtons, while at the same time being sufficiently sealed to admission to resist air during the lower pressure generated by the recovery of volume of the chamber, such that the recovery of volume displaces the inlet valve (6) sealing the opening connecting the chamber (10) to the reservoir (1) and consequently draws on fluid from the reservoir, in other words a volume that may for example attain 0.2 ml.

This simple configuration works for numerous types of products, for example a conventional washing up liquid of 500 centipoises viscosity. For really different viscosities, or to obtain different doses, the parameters in presence will have to change, and in particular the parameters of the material of the membrane, the dimension of the slit, as well as the design of the elastic compressible zone.

It should be noted that it complies with the teaching of the invention to admit air via the opening, if the chamber serves as reservoir of product. The chamber may in this case be advantageously provided with a plunger tube making it possible to supply product, the slit open.

The chamber may advantageously be made in the form of a piston sliding in a pump body and crushing a spring, to contain a cosmetic product.

The opening of the chamber may be reduced to a hole calibrated as a function of the slit, without any clapper. In this case, the replacement fluid will be preferentially the liquid or viscous product, in view of the expected backflows of product between the chamber and the reservoir. A clapper closing in the absence of lower pressure of the reservoir compared to the outside, in other words closing in presence of higher pressure of the chamber compared to the outside or at pressure equal to the chamber compared to the outside, is nevertheless more favourable to the characteristics of the invention and to the dosage of the dispensed product.

To reduce the opening pressure of the slit, it is possible to flare it towards the inside of the chamber, by making its lips not joined on the inside face of the chamber. The lower pressure inducing the admission of air via the slit then remains essentially unchanged in this operation and the escape of the product is facilitated in this configuration, in the sense that it takes place at lower higher pressure than without flaring. This flaring may be, for example, in the form of lips with a U-shaped (half-cylinder flaring) or "V-shaped" (ravine flaring) slit. The flaring towards the inside of the slit is defined by the fact that the edges of the slit are not in contact inside the chamber and are in contact outside, the profile of said edges of the slit being variable between these two extremes. It is thus possible, as indicated above, to flare the slit towards the inside of the chamber, to obtain an asymmetric behaviour, by rendering its lips not joined on the inside face of the chamber. This flaring may be around 30 to 70%. Ideally, it appears that with a flaring of around 50% the lower pressure inducing the admission of air via the slit then essentially remains unchanged in this operation and the escape of the product is greatly facilitated in this configuration, in the sense that it takes place at lower higher pressure than without flaring.

It is also possible to provide under the slit on the side of the inside of the chamber, a part on which the slit rests in the absence of deformation, laid flat on the part in a hermetic manner to air, the part being wider and longer than the slit. This part resists the admission of air via the slit without modifying the opening pressure of the slit, which enables an escape of the product.

This support part (203) or support, on which all or part of the slit rests in the absence of deformation of the slit, slows down the deformation of the slit towards the inside of the chamber so it increases considerably the return air or liquid penetration sealing. This support part (203) is a priori fixed and rigid, in other words in a configuration such as that of FIG. 1, connected to the body of the pump (10). Nevertheless, it may be provided that this part is flexible or semi-flexible in order to avoid its perception by the user or for design and operating choices. This may be done during the injection of the membrane which comprises, in its lower face, a hemispheric grid raised in its centre to form the support part (203).

It is possible to provide that this support part, in a flexible or rigid configuration, is wider and longer than the slit. This part then makes it possible to raise very markedly the level of air penetration sealing when the slit rests above.

Furthermore, to obtain also an asymmetric higher pressure and lower pressure behaviour of the slit according to the invention, another configuration consists in moulding a protuberance of the chamber underneath the slit, in other words inside the chamber. This protuberance is slit over part of its height when the incision of the slit is made via the outside of the chamber. This protuberance participates in a very simple manner to strengthening the air or liquid penetration resistance via the slit, in the chamber, without however significantly slowing down its outwards opening, outside of the chamber.

The possibility of playing on the opening and the slit enables the pump according to the invention to be applied to a reservoir of product for dishwashing or cosmetics, to extract the contents from it by a pressure that may slight and to enable the use of a hand or a washing utensil.

For the purposes of practically realising the invention, certain alternatives and indications below may profitably be implemented by those skilled in the art.

The behaviour of the device may be greatly improved by different direct or indirect interventions on the membrane. These interventions will target the following objectives:

- to facilitate the outflow of liquid via the slit towards the outside, in particular to limit the pressure force necessary to trigger the outflow of fluid, which also lowers the minimum higher pressure in the chamber necessary to obtain the start of the flow of liquid and thus avoid undesirable effects of spurting of the product towards the outside.
- to slow down the infiltration of air or liquid from the outside towards the inside, in other words obtain a better return sealing of the slit to limit the penetration of air or dirt via the slit, but also to allow the slit to withstand a considerably lower pressure, which enables the pump to generate a considerably lower pressure, particularly to draw a viscous liquid into the pump body, or instead a liquid markedly lower than the pump body, for example situated at 15 or 20 cm from the pump body such as may be found in certain plunger bottles or "bag-in-box" type flexible bags.

It is clearly apparent that these objectives may be conflicting. It is thus for the designer to seek the compromise that he wishes as a function, in particular, of the use that should be made of the pump according to the invention (gesture, effort, desired dose, etc.), the viscosity of the product, and the conservation conditions or constraints of the product.

In order to seek this compromise, said designer has at his disposal all of the parameters of the slit and its environment, namely, all of the characteristics intrinsic to the material, the thickness of the membrane and the perimeter of the membrane left free and the length of the slit. He also has at his disposal the parameters of compressible volume of the chamber, responsiveness of the return of the chamber to its initial position after compression and the behaviour of the inlet clapper. Routine tests then enable the optimisation of the invention through simple field operations.

These fundamental parameters may be used by the designer with a slit a priori as open to flow and sealed in one direction as in the other. This phenomenon does not prevent the pump operation described previously, particularly with a clapper, because the fact that the pump works effectively is due to a resistance to the backflow passage of the product, greater for the inlet clapper operating in closure, in presence of higher pressure, in relation to the resistance to the opening of the slit in output on the one hand, and to a lower resistance of the inlet clapper in admission compared to the penetration of air or liquid from the outside, via the slit, on the other hand. The combination of these characteristics assures a flow of product from the clapper or the hole towards the slit, creating a pump with very simple means.

Advantageously, the designer will also find in the following paragraphs additional useful solutions that will enable him to resolve more elegantly certain underlying contradictions or oppositions in the two principal objectives described previously and will allow him to design devices that are more efficient, simpler and also cheaper, for example by using less thick and less efficient materials such as for example polyurethane or even LDPE of 0.7 mm thickness.

These solutions in particular aim to provide the slit with an asymmetric behaviour, in other words that it behaves more or less as a fluidic diode, facilitating the passage of a fluid or a liquid product in one direction via the slit, to the detriment of the other direction, the opening of the slit being easier for a higher pressure or positive pressure difference between its faces than for a lower pressure or negative higher pressure between the same faces or instead the slit in the chamber opening more easily when a higher pressure is applied to the inside face rather than to the outside face of the chamber.

When the product is placed at higher pressure, the membrane sticks out naturally, which enables the detachment of the membrane from the support part and the escape of the product takes place without modifying significantly the opening pressure of the slit. Inversely, when there is lower pressure in the chamber, the slit is laid flat on the support part, which then makes it completely sealed.

It is also possible to work the general topography of the membrane. Thus, a convex membrane for the user will favour the opening of the slit and thus the easy outflow of liquid. A concave membrane for the user will disfavour the deformation of the membrane to open the slit, nevertheless, the choice of a concave membrane may be justified for reasons of use, particularly to facilitate the collection of the extracted product, or for technical reasons such as the good static behaviour of the device. Indeed, in certain designs such as that shown in FIG. 1, the reservoir is situated above the slit, this must therefore at least form a barrier to the natural flow of the liquid by gravity and the choice of a concave membrane for the user is a choice that may turn out to be pertinent.

Finally, it is possible to create a pre-tension of the membrane. To do this, a membrane is injected, the perimeter of which is slightly less wide than the installation perimeter, and to do this uniquely in the direction of the slit itself. For example, a split elliptical membrane inscribed in the installation circle is manufactured, the slit being cut in the small axis of the ellipse, this ellipse is then put on a cylindrical shape. The membrane thus has an interesting dynamic that makes it possible to reinforce the sealing effects in rest position, without significantly penalising the outward opening dynamic.

It will be noted in all of these designs that the zone of the membrane or wall of the chamber in the vicinity of the slit is always provided essentially plane viewed from the outside. When a concave or convex shape is described, it should be understood that the zone in the direct proximity of the slit and deformable with a view to obtaining the liquid, is a zone of high radius of bend, around 30 mm. For concave zones, configurations with a less important radius of bend may be imagined, of around 10 mm, which corresponds more or less to the diameter of a finger.

Whatever the case, the topography of the chamber must be essentially plane and smooth around the slit in order to facilitate the collection of the product in an intuitive gesture and without leaving retentions of products in the vicinity.

Obviously, printed designs, patterns in slight relief or flocked fibres could be added, but these additional elements must not protrude too much so as not to create significant retentions around the slit, which would risk generating hygiene problems.

It will be noted here that the sealing of the slit is due to the tensions of the material itself, coupled if necessary with the blocking effects of the membrane on the rest support described previously. It is important to consider that it is not in the least a sealing due to atmospheric pressure as in certain highly protruding flexible valves, where the lips of the valve are laid flat one against the other by the pressure difference between the inside of a volume and the outside at atmospheric pressure.

The chamber may moreover be deformable by pinching, as illustrated in FIGS. 2A and 2B with a finger or a utensil, and by sliding the pinching along the chamber in direction of the slit. In this case, the chamber is divided after pinching into two deformed parts. As the sliding progresses, the product is evacuated via the slit from the first part and the second part containing the opening develops towards the fully non deformed chamber and thus fills with fluid or replacement product, via the opening. The invention may thus form a manual pump or one activated by a washing utensil, suited to producing the pinching and the sliding, to extract the product from a reservoir of product, washing up liquid or cosmetic, up to a slit and to make it available to a user.

The invention is thus represented in FIG. 2A and FIG. 2B in its application to a pot (11) overhung by a withdrawal zone (13), connected to a pump according to the invention comprising an elastically deformable chamber (20) and bathed in an external medium which is air, a slit (17) and an opening (16), the chamber (20) containing a liquid or viscous product (18), comprising a blade (15) forming a partition between the chamber and the reservoir, communicating via the opening (16), the reservoir comprising a flexible bag (14) connected to the opening (16) and protected by the walls of the pot (11) provided with an air inlet (12).

With reference to FIG. 2A, the chamber (20) is deformable by pinching with the fingers or a utensil, as may be seen in FIG. 2B. The geometry of the blade (15) is a slightly lengthened cup so the chamber (20) at rest is a channel, represented in FIG. 2A in its longitudinal section and that during the deformation created by the pressure of a finger, the chamber (20) is blocked at the point of pinching so the chamber (20) is divided after pinching into two deformed parts (201) and (202), part (201) comprising the slit (17), and part (202) comprising the opening (16). By sliding the pinching along the chamber in the direction of the slit (17), in other words in the direction of the arrow (F) of FIG. 2B, the product is compressed below the pinching and evacuated via the slit (17) and the second part containing the opening (16) recovers its shape little by little until developing into the fully non-deformed chamber and thus fills with fluid coming from the reservoir, via the opening (16). If the finger continues to progress in the direction of the slit, when it reaches the slit (17), almost all of the liquid trapped in the part (201) has been evacuated and the finger thus collects the liquid. In this format may be noted the importance that the slit is positioned precisely at the end of the channel so in a single supple and continuous gesture, the user generates the expulsion of the liquid and its collection. When the finger leaves the surface (13), it recaptures its initial shape as it was at rest as may be seen in FIG. 2A. The return to the initial shape is achieved by the shape memory, or capacity to recover elastically its shape after deformation, of the material of the deformable zone, for example an elastomer of 40 Shore A hardness used at 1 mm thickness for a fluid cream or 1.5 mm or even 2 mm for a thicker cream. The shape memory of the material may also be combined with a spring effect, for example a very aerated foam of filter foam type, or instead fine protuberances moulded with the elastomer creating a spring effect.

The chamber may moreover be dismantleable in a part or sub-assembly containing the slit and another containing the opening for a replacement of one or the other of these components or sub-assemblies without discarding the whole or to facilitate its realisation.

In view of the present application, a first criterion of the invention appears to be a first strictly positive difference between the flow of product via the slit that is useful and the admission of a volume of air via the slit that is parasite. A zero value of this criterion corresponds for example to a simple outlet orifice constituted by a slit and not to a pump. The designer will seek to minimise this parasitic effect and it is possible to obtain, with the means described previously, devices according to the invention for which the admission of a volume of parasite air is insignificant.

As the pumping cycles progress, the air level of the contents of the chamber may be made to vary. During phases of priming the pump, the contents of the chamber may be composed uniquely of product or uniquely of air. During phases of use, a quantity of air can also be let into the chamber. For reasons of simplicity, the term product (8) will designate the contents of the chamber (10) during phases of use.

A second criterion of the invention also appears to be the equality of this first difference to a second difference between the volume of replacement fluid discharged through the opening when the pressing ceases and the volume of product discharged via the opening while pressing. The volume of product dispensed outside of the chamber then being exactly compensated by a volume of replacement fluid and the chamber fully reformed at the end of a cycle of pressing/loosening of the user. The designer will seek a priori to optimise the volume of liquid expulsed or useful volume for a nominal deformation of the chamber so he will equip more readily the opening of a clapper assuring an insignificant leak of fluid towards the reservoir.

The satisfaction of the first criterion distinguishes the invention from a slit output orifice, obtained for a first zero difference, and the second criterion distinguishes the invention from a plastically deformable reservoir and provided with a slit, obtained for an inequality.

As a function of the characteristics of flow of product and replacement fluid via the opening, it is possible with the invention to obtain a useful outflow of product, for a given pressing by a user, by adjusting the possible flow of product, for example by taking into account the viscosity of this product, so that the flow does not prevent the higher pressure from attaining a value inducing the opening of the slit. It is also possible symmetrically to adjust the elasticity of the chamber to the possible flow of replacement fluid via the opening, for example by taking into account the viscosity of the replacement fluid, which may be the product or air in particular, to enable the lower pressure to remain below a value inducing the opening of the slit, by lower pressure, and thus limit the admission of a volume of parasite air into the chamber.

The invention is thus, in all its generality, a pump in which the outlet orifice is a slit and is capable of industrial application in the field of liquid dispensers for dishwashing or product for cosmetics.

The invention claimed is:

1. A pump operable manually or by a utensil held in one hand by a user, comprising:

an elastically deformable chamber, the inside of which contains a liquid or viscous product and the outside of which is intended to be brought into contact with air at a slit made on a wall of the chamber and brought into contact with a replacement fluid at an opening on said chamber, wherein the chamber is suited to deforming elastically, by a pressing of a user, to create a higher pressure in the product than an outside pressure, and to open the slit, allowing a useful volume of product to escape from the slit, wherein the chamber makes the deformation elastically disappear, following a cessation of the pressing of the user, to create a lower pressure in the product, in the presence of a flow of replacement fluid through the opening towards the inside, and to close the slit, wherein an external surface of the wall of the chamber is essentially planar in a vicinity of said slit, and wherein the chamber comprises a support part, longer and wider than the slit, on which the slit is laid flat in a hermetic manner to air, under effect of the lower pressure.

2. A pump operable manually or by a utensil held in one hand by a user, comprising:

an elastically deformable chamber, the inside of which contains a liquid or viscous product and the outside of which is intended to be brought into contact with air at a slit made on a wall of the chamber and brought into contact with a replacement fluid at an opening on said chamber, wherein the chamber is suited to deforming elastically, by a pressing of a user, to create a higher pressure in the product than an outside pressure, and to open the slit, allowing a useful volume of product to escape from the slit, wherein the chamber makes the deformation elastically disappear, following a cessation of the pressing of the user, to create a lower pressure in the product, in the presence of a flow of replacement fluid through the opening towards the inside, and to close the slit, and wherein an external surface of the wall of the chamber is essentially plane in a vicinity of said slit wherein the chamber is firstly elastically deformable by pinching using a finger of the hand of the user, thereby dividing the chamber into a first part comprising the slit and a second part comprising the opening, and wherein the first part is deformable by sliding the finger on the chamber while maintaining the pinching, thereby making the product escape from the first part via the slit and letting the replacement fluid into the second part of the chamber.

* * * * *